US007120534B2

(12) United States Patent
Saito

(10) Patent No.: US 7,120,534 B2
(45) Date of Patent: Oct. 10, 2006

(54) IDLE REGULATING VALVE CONTROL SYSTEM FOR ENGINE

(75) Inventor: Chitoshi Saito, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/129,280

(22) Filed: May 13, 2005

(65) Prior Publication Data

US 2005/0263122 A1 Dec. 1, 2005

(30) Foreign Application Priority Data

May 20, 2004 (JP) ..... 2004-150993

(51) Int. Cl.
*F02D 41/06* (2006.01)

(52) U.S. Cl. ..... 701/112; 123/179.18

(58) Field of Classification Search ..... None
See application file for complete search history.

(56) References Cited

U.S. PATENT DOCUMENTS 5,564,387 A * 10/1996 Igarashi et al. ..... 123/339.23

FOREIGN PATENT DOCUMENTS

JP 11-270391 10/1999

* cited by examiner

*Primary Examiner*—Andrew M. Dolinar
(74) *Attorney, Agent, or Firm*—Knobbe, Martens, Olson & Bear, LLP

(57) ABSTRACT

An engine has a fuel injection system and an idle regulating control valve. The idle regulating valve is initialized upon engine shut down by closing to a fully closed position such that a reference value can be obtained in such a position. Once fully closed, the idle regulating valve is opened to a predetermined position and a value is written into memory that indicates that the initialization procedure has been completed. During subsequent restart, if it appears that the initialization procedure has not been completed prior to attempted restart, fuel injection is temporarily suspended. The fuel injection can be suspended during a subsequent initialization, until the idle regulating valve is fully closed or for a predetermined period of time. In some less refined applications, the idle regulating valve can be initialized during engine start up regardless of whether or not it is initialized during engine shut-down.

10 Claims, 7 Drawing Sheets

IDLE REGULATING VALVE CONTROL SYSTEM FOR ENGINE

BACKGROUND OF THE INVENTION

Related Applications

This application claims the priority benefit of Japanese Patent Application No. 2004-150993, filed on May 20, 2004, which is hereby incorporated by reference in its entirety.

1. Field of the Invention

The present invention generally relates to an engine provided with an idle regulating valve for supplying secondary air from the atmosphere to an intake pipe extending from a main engine unit. More particularly, the present invention relates to such an engine in which secondary air from the atmosphere is supplied to the intake pipe through the idle regulating valve when the engine is started.

2. Description of the Related Art

JP-A-Hei 11-270391 discloses an engine in which idle speed is regulated by air flow through a secondary air passage, which air flow is regulated by an idle regulating valve. The engine disclosed in the publication has a main engine unit that generates and outputs driving power. An intake pipe extends to the main engine unit and a throttle valve is positioned along the intake pipe. The throttle valve adjusts the opening of an intake passage inside the intake pipe. A fuel injection valve supplies fuel to the main engine unit. An idle regulating valve supplies secondary air from the atmosphere to the intake passage. A controller electronically controls operations of the fuel injection valve and the idle regulating valve.

In the engine disclosed in the Japanese publication, when the main engine unit is stopped, the controller initializes the idle regulating valve by moving the idle regulating valve to a fully closed position. When the idle regulating valve is fully closed, a reference value for controlling the idle regulating valve is determined and then the idle regulating valve is opened to a predetermined initial opening.

When the engine is operated, air from the atmosphere is supplied through the intake passage to the main engine unit. Fuel is added to the air passing through the intake pipe with the fuel injection valve. The air/fuel mixture is combusted within the engine. This generates thermal energy, which in turn causes the main engine unit to output driving power.

The throttle valve is opened or closed to adjust the opening of the intake passage (throttle opening) so that a predetermined quantity of air is drawn through the intake passage and the throttle valve into the main engine unit from the atmosphere. The air flow into the engine regulates the engine-speed.

When the engine is being driven, a sufficient quantity of air may not be supplied to the main engine unit under idle due to the smaller throttle opening. In this case, feedback control that is designed to achieve a target rotational speed of the engine opens the idle regulating valve. Thus, secondary air from the atmosphere is supplied through the idle regulating valve to the main engine unit in order to account for the air supply shortage. The combination of the air passing through the intake passage and the air passing through the secondary passage provides a sufficient volumetric air flow to maintain a desired idling condition.

Typically, the idle regulating valve is not provided with any sensor to detect its degree of opening. Providing such a sensor would complicate the engine design. Thus, in most engines, detecting an actual opening of the idle regulating valve while the engine is operating would be impossible. As a result, when operation of the main engine unit is stopped, such as by turning a main switch to an off-position, the idle regulating valve is initialized. By initializing the valve, accurate positioning of the valve during a subsequent restart can be obtained.

Currently, the idle regulating valve is initialized as soon as the main engine unit is stopped. To initialize the valve, the valve is first fully closed. Once fully closed, a reference value for position control is determined. The idle regulating valve is then opened to a predetermined initial opening position. Once in the predetermined initial opening position, secondary air is supplied to the main engine unit through the idle regulating valve during later subsequent restarts of the engine. Because the main air flow is supplemented by air passing through the idle regulating valve, sufficient air is provided to the main engine unit to encourage a smooth restart. Once the engine is operating, the position of the idle regulating valve is appropriately controlled during normal engine operation based on the reference value.

In accordance with the strategy described above, it is assumed that the main engine unit is stopped by turning the main switch off while the engine is operating normally and, accordingly, the idle regulating valve will be initialized by a moving it to a fully-closed position. Unfortunately, such a sequence of events does not always take place before the engine is restarted. In other words, it is conceivable that the main engine unit can be stopped for such a brief period of time that the idle regulating valve cannot complete its initialization procedure. In such a scenario, the main engine unit is stopped and, immediately thereafter, a restart of the main engine unit is attempted. Because initializing the idle regulation valve is not completed, the first ignition cycle of air-fuel mixture would likely occur in the main engine unit while the idle regulating valve is being closed for initialization. Thus, the idle regulating valve would not be brought into its fully closed position until the initial ignition cycle had already occurred. Such a situation would block introduction of secondary air into the main engine unit and could likely result in a supply shortage of air immediately after the first explosion. The sudden decrease in air supply would result in an abrupt stop of the engine. This abrupt engine stop would require one or more subsequent attempts to restart the engine, which is undesirable.

SUMMARY OF THE INVENTION

Accordingly, an engine is desired which can restart immediately after the main engine unit is stopped.

In one arrangement, an engine comprises a main engine unit. An intake pipe is connected to the main engine unit. The intake pipe defines an intake passage. A throttle valve is positioned within the intake passage. A fuel injection valve is connected to the main engine unit. An idle regulating valve is connected to the intake passage. A controller is electrically connected to the fuel injection valve and the idle regulating valve. The controller is configured to move the idle regulating valve to a fully closed state prior to initiating fuel injection during an engine start.

In another arrangement, a method of controlling an engine comprising an idle regulating valve and a fuel injection valve is provided. The method comprises performing an idle regulating valve initialization that comprises moving the idle regulating valve to a fully closed position, determining a reference value when the idle regulating valve is in the fully closed position, and opening the idle regulating valve to a predetermined position. The method further comprises storing in a memory location a value indicative of a completion of the idle regulating valve initialization and interrupting fuel injection at least until the idle regulating valve reaches its fully closed position.

BRIEF DESCRIPTION OF THE DRAWINGS

These and other features, aspects and advantages of the present invention will now be described with reference to the drawings of several preferred embodiments, which embodiments are intended to illustrate and not to limit the invention. The drawings comprise 5 figures.

DETAILED DESCRIPTION OF THE PREFERRED EMBODIMENT

With reference to the figures, an engine is provided with a control system and an idle regulation valve such that, upon engine shutdown, the idle regulation valve is closed and reset to a predetermined first position prior to the engine being restarted. In one configuration, the supply of fuel to the engine can be prevented until the idle regulation valve has been fully closed in a reset operation if the idle regulation valve is not fully reset prior to operation of a starter of the engine. In another configuration, the supply of fuel to the engine can be prevented for a predetermined period of time after the starter is operated if the idle regulation valve has not been reset prior to operation of the starter. In yet another configuration, the supply of fuel to the engine can be prevented until the idle regulation valve has been fully closed in a reset operation during subsequent restarting of the engine.

Figure 1:
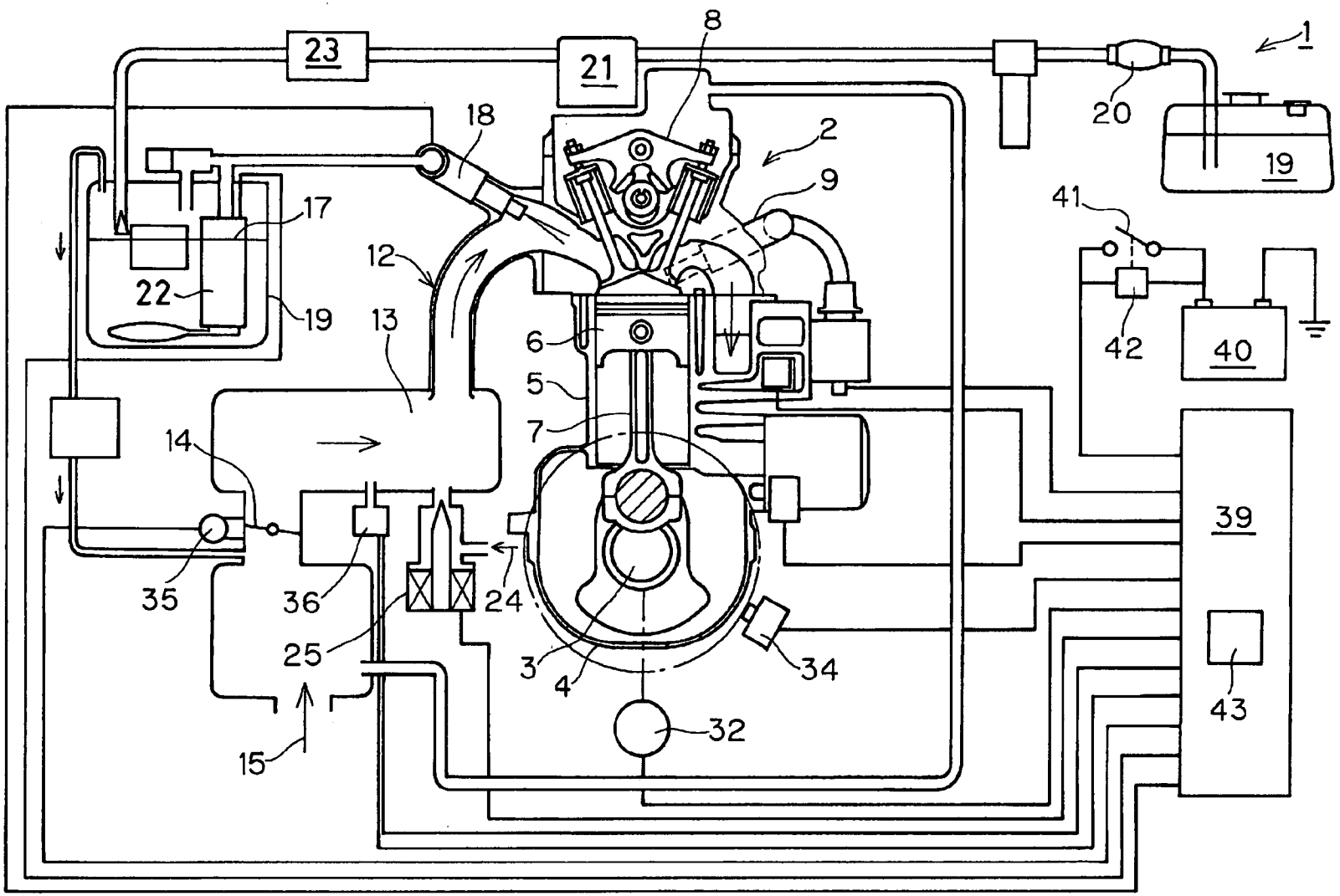
FIG. 1 is an overall schematic diagram of an engine that is arranged and configured in accordance with certain features, aspects and advantages of a first embodiment of the present invention.

With reference now to FIG. 1, reference numeral 1 denotes a four-stroke multi-cylinder engine (internal combustion engine) that can be mounted in or on a vehicle, such as the engines used in outboard motors, for instance but without limitation. The engine 1 has a main engine unit 2. The main engine unit 2 includes: a crankcase 4 for supporting a crankshaft 3; a cylinder 5 protruding from the crankcase 4; a piston 6 fitted into the cylinder 5; a connecting rod 7 for operatively connecting the crankshaft 3 and the piston 6 to each other; a valve mechanism 8; and an ignition plug 9.

The engine 1 has an intake pipe 12 extending from the main engine unit 2 and a throttle valve 14 for adjusting the opening (throttle opening) of the intake passage 13 inside the intake pipe 12, in which air 15 from the atmosphere flows sequentially to the throttle valve 14 and the intake passage 13 to be introduced to a combustion chamber in the main engine unit 2.

The engine 1 further has: a fuel injection valve 18 for supplying fuel 17 to the main engine unit 2 through the intake passage 13; a primary pump 20, a low-pressure pump 21 and a high-pressure pump 22, which are designed to deliver fuel 17 from a fuel tank 19 to the fuel injection valve 18; and a fuel filter 23 for filtering sediment and other impurities from the fuel 17. In some configurations, the fuel injection valve 18 can be solenoid-operated. The engine can utilize direct cylinder injection in some arrangements and can use indirect or port injection in other arrangements.

Figure 2:
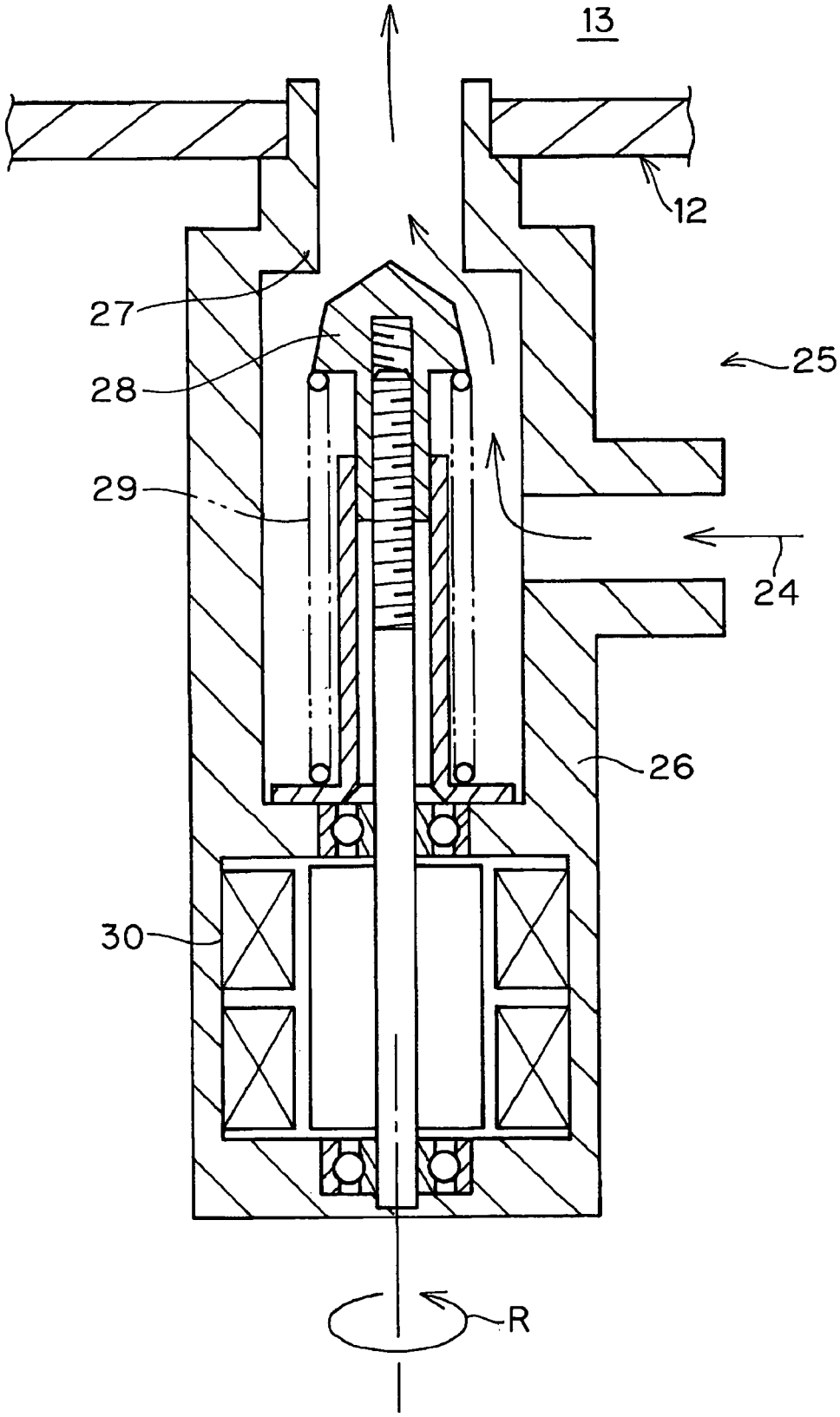
FIG. 2 is a simplified sectional view of an idle regulating valve that is used in the arrangement of FIG. 1.

With reference to FIGS. 1 and 2, an idle regulating valve 25 is provided for supplying secondary air 24 from the atmosphere to the intake passage 13 as appropriate. The idle regulating valve 25 can be an idle speed control (ISC) valve, which has: a valve box 26 fixed to the intake pipe 12; a valve seat 27 formed on the valve box 26; a valve body 28 for opening or closing the valve seat 27; a spring 29 for elastically biasing the valve body 28 to a closed position; and a stepping motor 30 or an actuator for opening or closing the valve body 28. Other suitable valve configurations also can be used. In the illustrated arrangement, driving the stepping motor 30 in a first direction as shown by the arrow (R) opens the valve body 28, thereby opening the valve seat 27 while driving the stepping motor 30 in a reverse direction relative to the arrow (R) closes the valve body 28, thereby contacting the valve seat 27.

A starter 32 or a starter motor is operatively connected to a crankshaft 3 of the main engine unit 2. Actuating the starter 32 rotates the crankshaft 3 during engine starting.

In the main engine unit 2, there are provided: a crank angle detecting sensor 34 for detecting a crank angle of the crankshaft 3; an opening detecting sensor 35 for detecting a throttle opening of the throttle valve 14; and a negative-pressure detecting sensor 36 for detecting a negative-pressure in the intake passage 13. Other suitable sensors also can be provided.

An engine controller 39 is provided for electrically controlling the engine 1. To the controller 39 are electrically connected the ignition plug 9, the fuel injection valve 18, the primary pump 20, the low-pressure pump 21, the high-pressure pump 22, the stepping motor 30 for the idle regulating valve 25, the starter 32 and the respective sensors 34 to 36. A battery 40 is also connected to the controller 39 to supply power to the controller 39 via a main switch 41. A latching circuit 42 is used in the illustrated arrangement to hold the main switch 41 in an on-position and the latching circuit includes a main relay. The controller 39 advantageously has a memory 43 for storing an indicator of the completion status of an idle regulating valve initializing control, which will be discussed later. In the illustrated arrangement, the memory 43 is made up of an EEP and a ROM. Other suitable configurations also can be used.

When the engine 1 is controlled by the controller 39, air 15 from the atmosphere is supplied through the intake passage 13 to the main engine unit 2, to which fuel 17 is also supplied by the fuel injection valve 18 for combustion. This generates thermal energy, which is converted to mechanical energy, which causes the main engine unit 2 to output driving power.

The throttle valve 14 is opened or closed to adjust the opening of the intake passage 13 (throttle opening), so that a predetermined quantity of the air 15 is drawn through the intake passage 13 and the throttle valve 14 into the main engine unit 2 from the atmosphere. This can regulate the operating condition of the engine 1, such as high-speed operation and low-speed operation.

When the engine 1 is operating, a sufficient quantity of the air 15 may not be supplied to the main engine unit 2 during idling operation due to the smaller degree of throttle opening. To compensate, the controller 39 uses feedback control that is designed to achieve a target rotational speed of the engine 1 by opening and closing the idle regulating valve 25, as appropriate. Thus, secondary air 24 from the atmosphere is supplied through the idle regulating valve 25 to the main engine unit 2 in order to make up for a supply shortage of the air flowing past through the throttle opening. This maintains a suitable idling condition.

In the illustrated arrangement, the idle regulating valve 25 is not provided with an opening-detecting sensor in order to simplify the physical construction of the engine 1. Thus, when the main engine unit 2 is stopped by turning the main switch 41 off, an initializing control is implemented, such that appropriate control for operating the idle regulating valve 25 to open or close is possible while the engine is otherwise operating after the restart of the main engine unit 2.

When the main engine unit 2 is stopped, the initializing control first closes the idle regulating valve 25 until it is fully closed, under which state a reference value for the initializing control is determined. The idle regulating valve 25 is then opened to a predetermined initial opening. After the initial opening is achieved, secondary air 24 is supplied to the main engine unit 2 through the idle regulating valve 25 at the restart of the engine 1. This encourages a smooth restart of the engine. Accordingly, completion of the initializing control requires positioning the idle regulating valve 25 in the predetermined initial opening. Upon restart of the engine, the idle regulating valve can be appropriately controlled based on any suitable control strategy (e.g., a reference value depending upon the operating parameters of the engine 1) which, in some embodiments, can be operated relative to the reference value generated during the initializing control.

Figure 3:
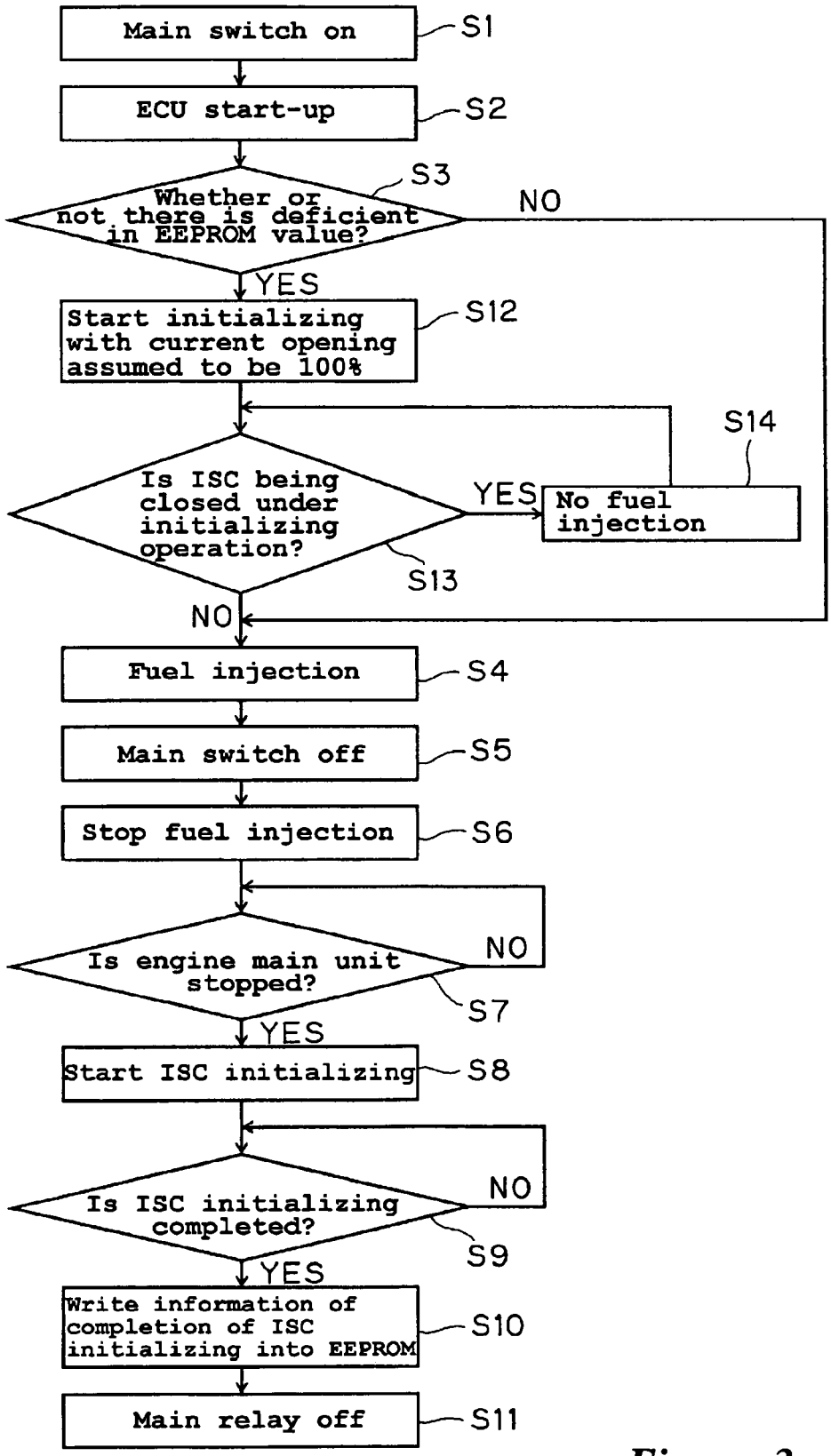
FIG. 3 is a flowchart of a control system that is arranged and configured in accordance with certain features, aspects and advantages of the present invention.
Figure 4:
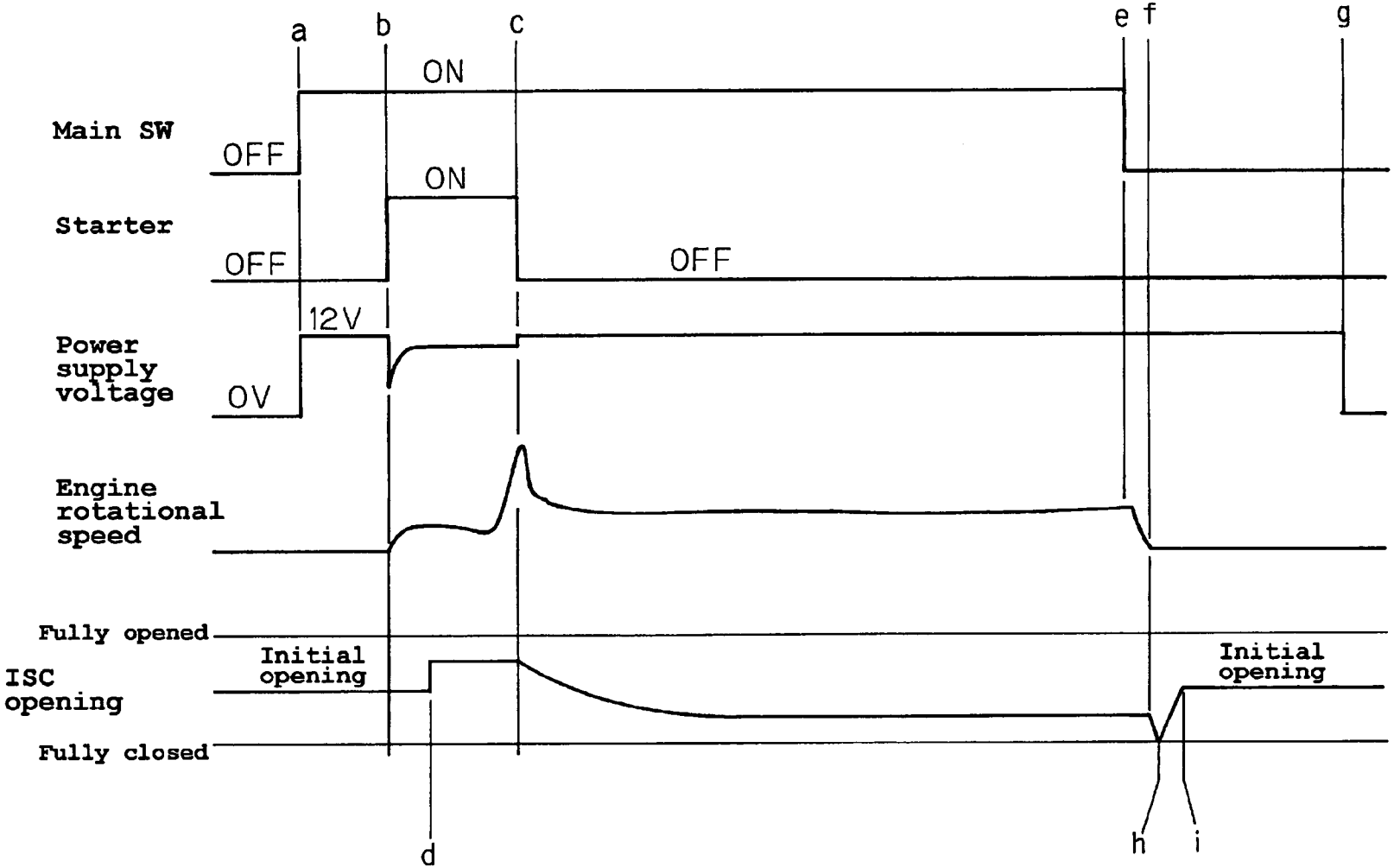
FIG. 4 is a timing chart showing a normal driving condition of the engine of FIG. 1.
Figure 5:
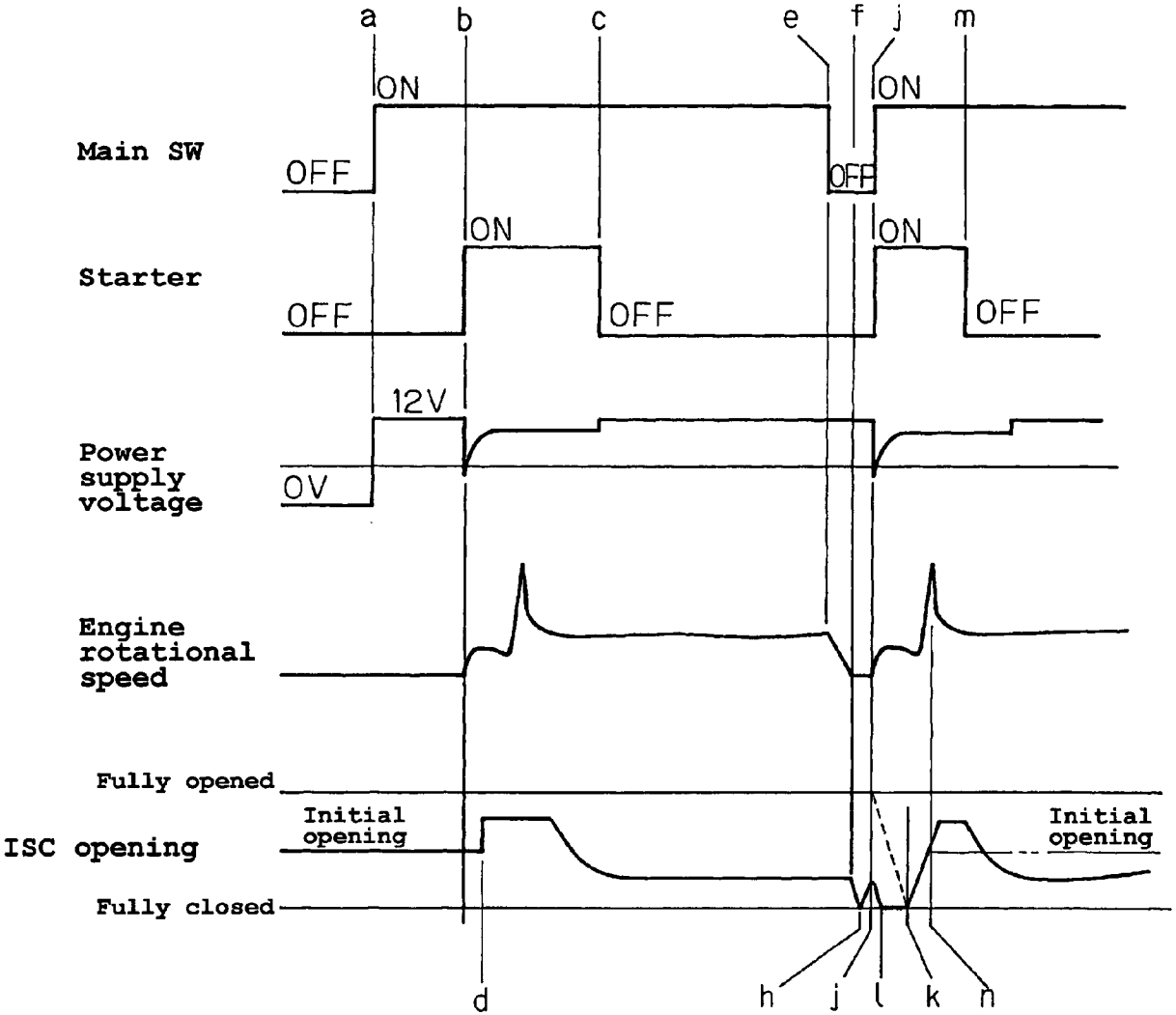
FIG. 5 is a timing chart showing a different driving condition of the engine of the FIG. 1.

With reference now to FIGS. 3–5, a control routine will be described that can be used to provide complete initialization of the idle regulating valve before combustion begins. With reference initially to FIG. 3, a flowchart of one control process for the controller 39 is illustrated in which symbol S denotes each step of the program. FIG. 4 provides a time chart that reflects a relatively normal operating condition of the engine 1. FIG. 5 provides a comparable time chart in which the engine 1 is rapidly restarted following shutdown. In FIG. 5, detailed descriptions of common parts and components with the same reference numeral as those shown in FIG. 4 are not repeated.

With reference to arrangement illustrated in FIGS. 3 and 4, when the main switch 41 is turned on (S1 in FIG. 3 and occurring at time (a) in FIG. 4), the power supply voltage of the controller 39 increases from zero V to 12V through the battery 40, so that the controller 39 powers-up (S2 in FIG. 3). Then, a determination is made whether or not there is something abnormal in the contents stored in the memory 43 or something different from the intended contents (S3 in FIG. 3). To be more specific, a value, other than the value to be stored in the ROM when the previous initializing control has been completed, corresponds to "abnormal." On the other hand, a value equal to the value to be stored in the ROM when the aforementioned initializing control has been completed is determined not "abnormal" but normal. The value to be stored in the ROM when the initializing control has been completed refers to a value which indicates that the idle regulating valve 25 is in the initial opening state (ISC opening at (a) in FIG. 4). For instance, a flag can be used to indicate when the idle regulating valve has moved from a fully closed position to the predetermined initial opening. The flag value might increment or decrement upon each restart such that a distinction between a prior initialization and an expected current initialization can be maintained. In other arrangements, such as that illustrated, the value stored in memory is erased or written to zero once the idle regulating valve begins being controlled during normal engine operation.

At S3 in FIG. 3, it is assumed that the contents stored in the memory 43 would be determined not abnormal but normal. If such a determination is made, the starter 32 is activated ((b) to (c) in FIG. 4) and the fuel injection valve 18 injects fuel 17 (S4 in FIG. 3) for supply to the main engine unit 2. Activating the main engine unit 2 allows the engine 1 to start ((b) to (C) in FIG. 4).

As described above, the engine 1 is a multi-cylinder engine. Thus, at the start of the engine 1, a single pulser coil can be used to determine the operational state (e.g., compression, expansion, ignition, etc.) of each cylinder. Next, based on the signals detected by the pulser coil, the fuel injection valve 18 causes the fuel 17 to be supplied sequentially to each cylinder. In this case, however, figuring out which stroke each cylinder is on causes a delay in supplying the fuel 17. Therefore, it would possibly take longer to start the engine 1 after cranking by activating the starter 32. Therefore, in one embodiment, the fuel 17 is pre-injected by each fuel injection valve 18 while the operational state of each cylinder is detected, such as by the pulser coil. This can reduce the time between cranking and starting of the engine 1.

In the above-described situation, after the controller 39 starts-up with the operation of the main switch 41, the environmental conditions, such as a cold climate, can be initially detected prior to figuring out which stroke each cylinder is on. Based on the detected signal, a quantity of the fuel 17 to be injected by the fuel injection valve 18 for each cylinder can be determined, as well as which fuel injection valve 18 to pre-inject. Thus, the above configuration can provide an engine start that is suitable for the environment conditions, and therefore, the engine 1 can start immediately upon cranking by the starter 32.

In contrast, if the starter 32 is activated in order to start the engine 1 as described above, the power supply voltage of the controller 39 may sharply decrease once (see time (b) in FIG. 4). Such a sharp decrease in voltage could cause the controller 39 to be temporally turned off. The idle regulating valve 25 can start operating after a lapse of predetermined time ((b) to (d) in FIG. 4) once the starter 32 is activated. As mentioned above, the contents stored in the memory 43 preferably are cleared at the operation start of the idle regulating valve 25.

When the engine 1 is started ((b) in FIG. 4), the feedback control by the controller 39, which is designed to achieve the target rotational speed of the engine 1, opens the idle regulating valve 25 ((d)–(c) in FIG. 4). The secondary air 24 is then supplied to the main engine unit 2 through the idle regulating valve 25 and the intake passage 13. This greatly reduces the likelihood of a shortage of the supply of air 15, 24 to the main engine unit 2, which provides a smoother start of the engine 1. After the engine starts, normal operation of the engine 1 is maintained ((c) to (e) in FIG. 4).

Turning the main switch 41 off to stop engine operation (S5 in FIG. 3 and time (e) in FIG. 4) stops injection of the fuel 17 by the fuel injection valve 18 (S6 in FIG. 3), resulting in a gradual stop of the main engine unit 2 ((e) to (f) in FIG. 4). Although the main switch 41 has been turned off, the latching circuit 42 maintains the power supply voltage of the controller 39 substantially constant for a predetermined time ((f) to (g) in FIG. 4). After the main engine unit 2 has stopped (S7 in FIG. 3, (f) in FIG. 4), the initializing control of the idle regulation valve starts and the controller 39 can properly control the idle regulating valve 25 (S8 in FIG. 3 and (f) in FIG. 4).

Under the initializing control, stopping the main engine unit 2 first causes the idle regulating valve 25 to close to the fully closed state ((h) in FIG. 4). A reference value for the initializing control is determined in this fully closed state. After that, the idle regulating valve 25 is appropriately controlled relative to the reference value while the engine 1 is being operated under normal conditions.

The idle regulating valve 25 is opened to a predetermined initial opening (times (h) to (i) in FIG. 4). In other words, opening the idle regulating valve 25 results in a supply of the secondary air 24 to the main engine unit 2 through the idle regulating valve 25 immediately at a restart of the engine 1. This allows a sufficient supply of the air 15, 24 to the entire engine main unit 2, providing a smooth start of the engine. When the idle regulating valve 25 is positioned in the predetermined initial opening position, the initializing control is completed (S9 in FIG. 3 and (i) in FIG. 4).

Next, the completion status of the initializing control is written to the memory 43 and stored therein. More specifically, a value, which indicates that the idle regulating valve 25 has been opened to the predetermined initial opening, is written and stored in the memory 43 (S10 in FIG. 3). Then, the latching circuit 42 is automatically turned off, and therefore the controller 39 is turned off (S11 in FIG. 3 and (g) in FIG. 4).

The timing diagram of FIG. 5 illustrates that the initialization of the idle regulating valve 25 is completed before the engine is started. As shown, when the main engine unit 2 is stopped by turning the main switch 41 off (S5 in FIG. 3 and timing (e) in FIGS. 4 and 5), the initializing control for the idle regulating valve 25 starts (S8 in FIG. 3 and timing (f) in FIGS. 4 and 5). If the main switch 41 then is turned on (S1 to S3 in FIG. 3 and time (j) in FIG. 5) and the starter 32 is turned on (time (j) in FIG. 5), which is designed to restart the engine 1, during the course of the initializing control, the fuel injection is suspended until the initializing control has completed.

Then, in S3 in FIG. 3, a determination is made whether or not there is something abnormal in the contents stored in the memory 43. In this situation, since the initializing control is under way, no completion status of the initializing control is stored in the memory 43. Thus, in S3 in FIG. 3, the contents stored in the memory 43, which are different from those intended to indicate the completion status of the initializing control, are determined to be abnormal. The idle regulating valve 25 is again subject to the initializing control (S12, S13 in FIG. 3 and (j) to (m) in FIG. 5).

As a process of the initializing control, first it is assumed in S12 that the idle regulating valve 25 is in the fully opened state (100%). Next, the information of the number of operation pulses counted until the idle regulating valve 25 expectedly reaches the fully closed state (0%) is provided for the stepping motor 30 of the idle regulating valve 25. Closing operation of the idle regulating valve 25 starts (S12 in FIG. 3 and (j) in FIG. 5).

According to the program for S12, the idle regulating valve 25 is assumed to continue its closing operation. However, the idle regulating valve 25 is substantially in the fully closed state ((l) in FIG. 5). After that, the idle regulating valve 25 is actually maintained in the fully closed state with its closing operation stopped ((l) to (k) in FIG. 5). In contrast, under the initializing control, the idle regulating valve 25, which is assumed to be in the fully opened state, is supposed to continue its closing operation to the intended fully closed state (S13 in FIG. 3, See a dotted line in (j) to (k) in FIG. 5).

Even if the starter 32 is maintained on (j) to (m) in FIG. 5) in order to restart the engine 1, the fuel injection valve 18 is stopped from injection until the idle regulating valve 25 becomes fully closed ((k) in FIG. 5) in the program for S12. In other words, a supply of the fuel 17 to the main engine unit 2 by the fuel injection valve 18 is stopped unless the idle regulating valve 25 is brought in the fully closed state ((k) in FIG. 5) under the initializing control, thereby preventing a first ignition from occurring in the main engine unit 2 (S14 in FIG. 3).

Next, the idle regulating valve 25 is opened to the predetermined initial opening ((n) in FIG. 5). In this case, the main engine unit 2 is being operated. So after that, the main engine unit 2 continues to be operated by opening or closing the throttle valve 14 and the engine 1 operates normally ((c)–(e) in FIG. 4 and from (m) onward in FIG. 5).

The aforementioned configuration is provided with the memory 43 for storing the completion status of the initializing control. At the start of the engine 1, if there is something abnormal in the contents stored in the memory 43 or different from the intended contents, the idle regulating valve 25 is subject to the initializing control, during which supply of fuel 17 by the fuel injection valve 18 is stopped unless the idle regulating valve 25 is brought in the fully closed state.

When the engine 1 is restarted immediately after the main engine unit 2 is stopped, if the initializing control is under way, the memory 43 would not reflect that the initializing control has been completed. Therefore, at the restart of the engine 1, the contents stored in the memory 43, which are different from those intended to indicate the completion status of the initializing control, would be determined to be abnormal. Then, the idle regulating valve 25 is again subject to the initializing control, as previously mentioned.

Figure 6:
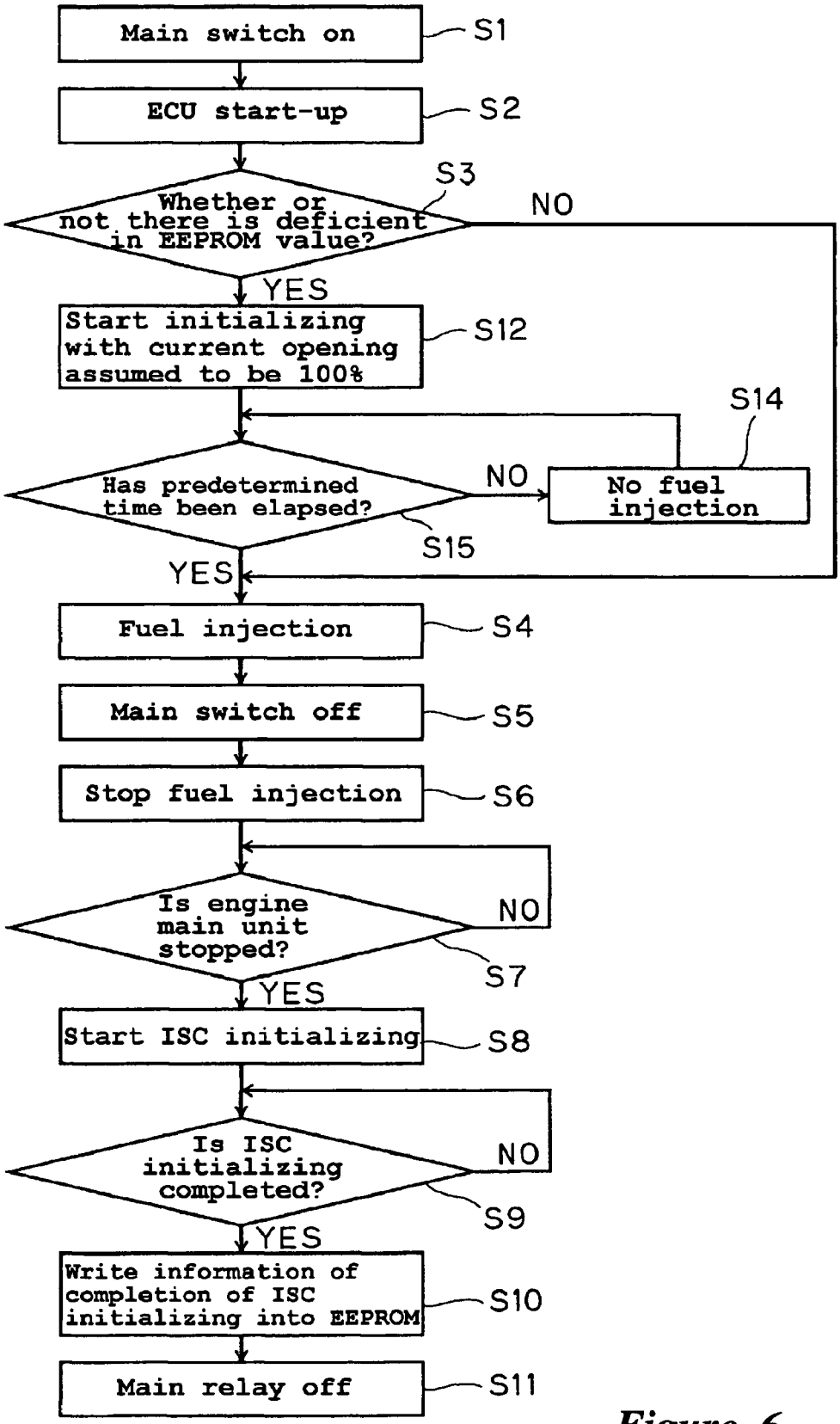
FIG. 6 is a flowchart of another control system that is arranged and configured in accordance with certain features, aspects and advantages of the present invention.
Figure 7:
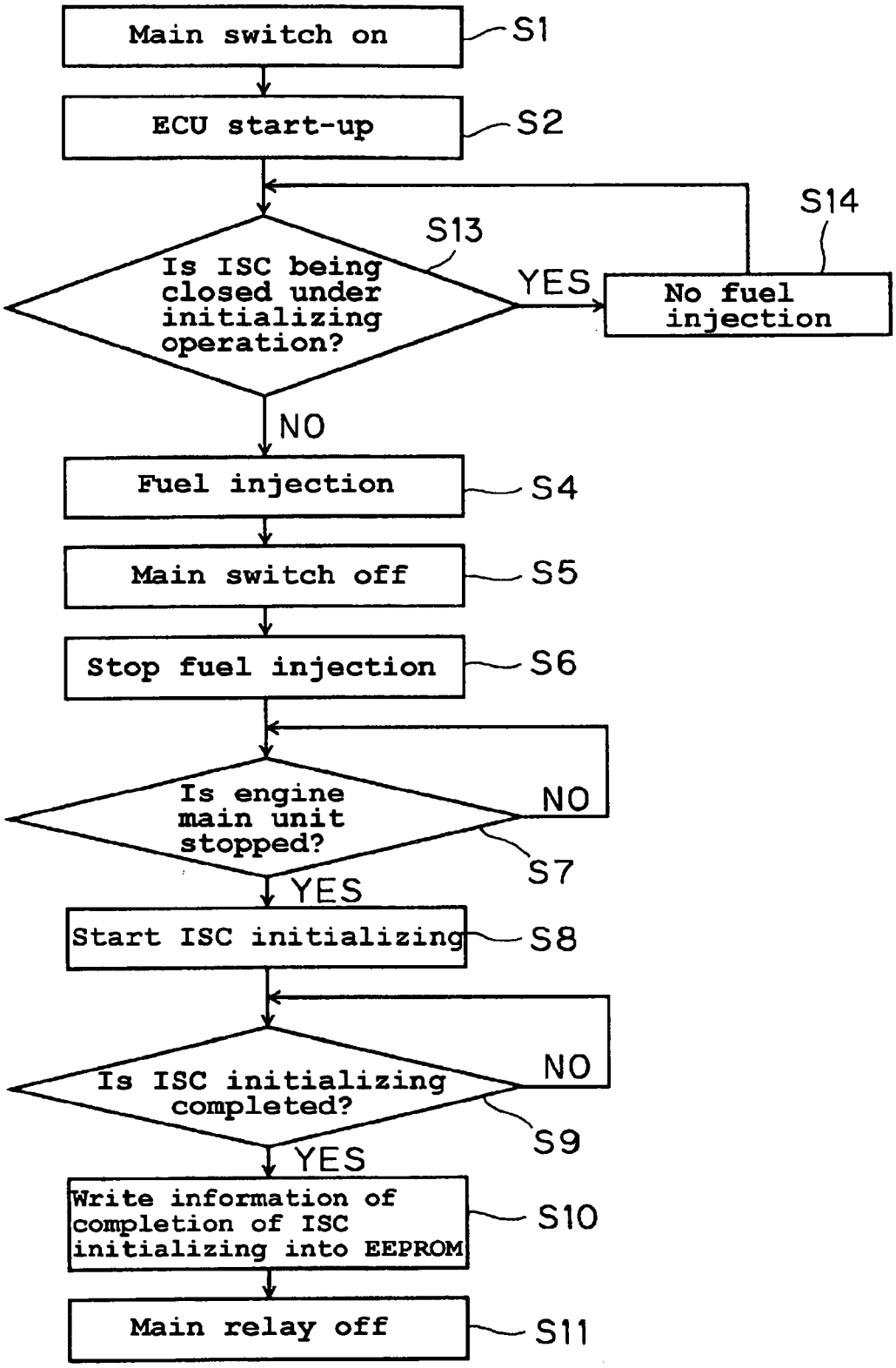
FIG. 7 is a flowchart of a further control system that is arranged and configured in accordance with certain features, aspects and advantages of the present invention.

With reference now to FIGS. 6 and 7, two additional control routines that are arranged and configured in accordance with certain features, aspects and advantages of the present invention are illustrated therein. The components, functions and effects of these embodiments are similar in many respects to those of the first embodiment above. Thus, redundant descriptions will not be provided and identical reference numerals or symbols will be provided to the corresponding components. Thus, the following description will focus mainly upon the differences between the arrangement described above and the arrangements of FIGS. 6 and 7. It should be noted that certain features, aspects and advantages of each of the embodiments described herein can be integrated into others of the embodiments described herein.

With reference now to FIG. 6, S15 is incorporated in the routine of FIG. 3 in place of S13. In S15, after the engine 1 is started by turning the starter 32 on at S12 while the idle regulating valve 25, which is assumed to be in the fully opening state, starts its closing operation, a supply of the fuel 17 by the fuel injection valve 18 is stopped until a predetermined time of period has been elapsed following cranking of the engine 1 by the starter 32.

As described above, it is assumed that the main switch 41 is turned off while the engine is operating so that the main engine unit 2 is stopped. This causes the idle regulating valve 25 to be subject to the initializing control. In this case, immediately after the main engine unit 2 is stopped, the main switch 41 and the starter 32 are both turned on in order to restart the main engine unit 2. Therefore, unlike the conventional configuration, this prevents the engine 1 from stopping long enough prior to restart for initialization to be completed. In other words, when the engine 1 is restarted immediately after the main engine unit 2 is stopped, if the initializing control is under way, no completion status of the initializing control would be stored in the memory 43. Therefore, at the restart of the engine 1, the contents stored in the memory 43, which are different from those intended to indicate the completion status of the initializing control, are determined to be abnormal. Thus, a supply of the fuel 17 to the main engine unit 2 by the fuel injection valve 18 is stopped until a predetermined time of period has been elapsed, as previously noted. That is, this prevents the first ignition from occurring in the main engine unit 2 before the idle regulating valve 25 is fully closed.

With reference now to FIG. 7, S3 and S12 of the routine shown in FIG. 3 are removed in the routine shown in FIG. 7. The main switch 41 is turned on (S1) so that the controller 39 starts-up, which immediately leads to the implementation of the initializing control for the idle regulating valve 25 (S13). A supply of the fuel 17 by the fuel injection valve 18 is stopped (S14) unless the idle regulating valve 25 is fully closed under the initializing control.

As described above, it is assumed that the main switch 41 is turned off while the engine is operating which leads to stoppage of the main engine unit 2. This causes the idle regulating valve 25 to be subject to the initializing control. In this case, immediately after the main engine unit 2 is stopped, the main switch 41 and the starter 32 are both turned on in order to restart the main engine unit 2. Therefore, unlike the conventional configuration, this prevents the engine 1 from stopping long enough prior to restarting such that initialization cannot be completed. In other words, when the engine 1 is restarted immediately after the main engine unit 2 is stopped, whether the initializing control is under way or not, the idle regulating valve 25 is again subject to the initializing control.

Under the initializing control, a supply of the fuel 17 to the main engine unit 2 by the fuel injection valve 18 is stopped unless the idle regulating valve 25 is brought in the fully closed state. That is, this prevents the first ignition from occurring in the main engine unit 2 before the idle regulating valve 25 is brought in the fully closed state.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. As used herein, "abnormal" contents stored in the memory 43 includes contents that are different from any intended data stored and also includes no contents, which indicates that initialization has not been completed. In some arrangement, the main switch 41 can be a kill switch. Accordingly, the scope of the present invention is intended to be defined only by the claims that follow.

What is claimed is:

1. An engine comprising a main engine unit, an intake pipe connected to said main engine unit, said intake pipe defining an intake passage, a throttle valve positioned within said intake passage, a fuel injection valve connected to said main engine unit, an idle regulating valve connected to said intake passage, a controller electrically connected to said fuel injection valve and said idle regulating valve, said controller configured to move said idle regulating valve to a fully closed state prior to initiating fuel injection during an engine start, said controller moving said idle regulating valve to said fully closed state and subsequently moving said idle regulating valve to a predetermined position in an idle regulating valve initialization, said idle regulating valve initialization occurring upon shut-down of the engine.

2. The engine of claim 1, wherein a reference value indicating that said idle regulating valve initialization has been completed is stored in a memory location and, at a subsequent start of the engine, if a value in said memory location does not match said reference value then the idle regulating valve is subject to a restart idle regulating valve initializing control during which a supply of fuel by said fuel injection valve is stopped until the idle regulating valve can be fully closed.

3. The engine of claim 1, wherein a reference value indicating that said idle regulating valve initialization has been completed is stored in a memory location and, at a subsequent start of the engine, if a value in said memory location does not match said reference value then a supply of fuel by said fuel injection valve is stopped until a predetermined time of period has been elapsed since said subsequent restart of the engine.

4. An engine comprising a main engine unit, an intake pipe connected to said main engine unit, said intake pipe defining an intake passage, a throttle valve positioned within said intake passage, a fuel injection valve connected to said main engine unit, an idle regulating valve connected to said intake passage, a controller electrically connected to said fuel injection valve and said idle regulating valve, said controller configured to move said idle regulating valve to a fully closed state prior to initiating fuel injection during an engine start, said controller moving said idle regulating valve to said fully closed state and subsequently moving said idle regulating valve to a predetermined position in an idle regulating valve initialization, and at the start of the engine, the idle regulating valve being subject to said idle regulating valve initialization during which a supply of the fuel by said fuel injection valve is stopped until the idle regulating valve is brought in the fully closed state.

5. A method of controlling an engine comprising an idle regulating valve and a fuel injection valve, said method comprising performing an idle regulating valve initialization that comprises moving said idle regulating valve to a fully closed position, determining a reference value when said idle regulating valve is in said fully closed position, opening said idle regulating valve to a predetermined position, storing in a memory location a value indicative of a completion of said idle regulating valve initialization and interrupting fuel injection at least until said idle regulating valve reaches its fully closed position.

6. The method of claim 5, wherein said idle regulating valve initialization is performed upon engine shutdown.

7. The method of claim 6, wherein during engine starting, if said memory location does not indicate completion of said idle regulating valve initialization, said fuel injection is interrupted until said idle regulating valve reaches its fully closed position.

8. The method of claim 6, wherein during engine starting, if said memory location does not indicate completion of said idle regulating valve initialization, said fuel injection is interrupted for a predetermined period of time sufficient to allow said idle regulating valve to reach said fully closed position.

9. The method of claim 6, wherein during engine starting, said idle regulating valve initialization occurs regardless of whether said idle regulating valve initialization has been completed during an immediately prior engine shutdown.

10. The method of claim 6, wherein, during engine startup, said fuel injector pre-injects fuel if said memory location indicates complete of said idle regulating valve initialization.

* * * * *